US006017006A

United States Patent [19]

Cherubini et al.

[11] Patent Number: 6,017,006

[45] Date of Patent: Jan. 25, 2000

[54] KEYBOARD WRIST REST

[75] Inventors: Julian H. Cherubini, Newton; Jonathan C. Bretz, Maynard, both of Mass.

[73] Assignee: Alimed, Inc., Dedham, Mass.

[21] Appl. No.: 07/822,358

[22] Filed: Jan. 12, 1992

Related U.S. Application Data

[63] Continuation-in-part of application No. 07/592,619, Oct. 4, 1990.

[51] Int. Cl.[7] ..... B41J 11/62

[52] U.S. Cl. ..... 248/118; 248/118.1; 248/918; 400/715

[58] Field of Search ..... 248/118, 118.1, 248/118.3, 118.5, 127, 126, 205.3, 345.1, 918; 297/411; 400/715

[56] References Cited

U.S. PATENT DOCUMENTS

| | | | |
|---|---|---|---|
| D. 160,224 | 9/1950 | Smyth . | |
| D. 293,496 | 12/1987 | Gentes . | |
| 351,509 | 10/1886 | Hertz | 248/345.1 |
| 393,496 | 11/1888 | Ashby . | |
| 1,227,169 | 5/1917 | Medanich . | |
| 1,289,861 | 12/1918 | Mills . | |
| 1,632,537 | 6/1927 | Brigel . | |
| 1,801,669 | 4/1931 | Hintz et al. . | |
| 1,920,889 | 8/1933 | Pullen . | |
| 1,979,773 | 11/1934 | Ritch . | |
| 2,193,414 | 3/1940 | Berkman . | |
| 2,325,414 | 7/1943 | McChesney et al. . | |
| 2,604,147 | 7/1952 | Havel | 297/411 |
| 2,614,155 | 10/1952 | Lippy . | |
| 2,950,890 | 8/1960 | Hough . | |
| 3,099,774 | 7/1963 | Crane . | |
| 3,268,766 | 8/1966 | Amos . | |
| 3,300,250 | 1/1967 | Dollgener | 297/411 |
| 3,330,173 | 7/1967 | Hirschfield et al. . | |
| 3,330,250 | 7/1967 | Runge . | |
| 3,711,742 | 1/1973 | Pinkham, Jr. . | |
| 4,066,171 | 1/1978 | Fowlie . | |
| 4,303,960 | 12/1981 | Sherwood et al. . | |
| 4,313,112 | 1/1982 | Foster . | |
| 4,481,556 | 11/1984 | Berke et al. . | |
| 4,482,063 | 11/1984 | Berke et al. . | |
| 4,482,064 | 11/1984 | Berke et al. . | |
| 4,545,554 | 10/1985 | Latino | 248/118.1 |
| 4,597,606 | 7/1986 | Magee | 248/118 X |
| 4,621,781 | 11/1986 | Springer | 400/715 |
| 4,688,862 | 8/1987 | Fowler et al. . | |
| 4,703,531 | 11/1987 | Bissett | 248/118 |
| 4,709,972 | 12/1987 | LaBudde et al. . | |
| 4,770,466 | 9/1988 | Pesterfield | 248/118 |
| 4,869,543 | 9/1989 | Grimes | 248/118 |
| 4,913,390 | 4/1990 | Berke . | |
| 4,973,176 | 11/1990 | Dietrich | 400/715 |
| 5,022,622 | 6/1991 | Schaevitz | 248/118 X |
| 5,131,614 | 7/1992 | Garcia et al. | 248/118 |
| 5,141,285 | 8/1992 | Park | 297/421 X |
| 5,195,705 | 3/1993 | Kline et al. | 248/118 X |
| 5,197,699 | 3/1993 | Smith et al. | 248/118 |

OTHER PUBLICATIONS

Wrist Pad Plus—Marty's Computer Workshop 1990.
Wrist–Stop—G.M.E. Inc. 1990.
Keyboard Wrist Rest—AliMed Inc 1990.

*Primary Examiner*—Derek J. Berger
*Attorney, Agent, or Firm*—Wolf, Greenfield & Sacks, P.C.

[57] ABSTRACT

A keyboard wrist rest supports wrists in a comfortable position in front of a keyboard by use of a plural functional layered device having a cradling layer operatively engaging the wrist in use, and a support firm wrist positioning layer providing for a defined wrist support distance above an operating surface. The plural layered wrist rest device can have a firm foam acting as the positioning layer and a soft foam acting as a cradling layer for the wrist.

13 Claims, 1 Drawing Sheet

KEYBOARD WRIST REST

RELATED APPLICATION

This application is a continuation-in-part of U.S. patent application Ser. No. 07/592,619 filed Oct. 4, 1990.

BACKGROUND OF THE INVENTION

This invention relates to the use of keyboards as in typewriter, computer, musical instrument, and other keyboard devices where the hands manually operate the keyboards. Traditionally, experienced, trained typists hold their hands aloft from a keyboard in use so that their wrists are in a neutral or unextended position, or slightly flexed. The same kind of position is useful for pianists and others who do a lot of keyboard work either with musical instruments, computers, typewriters and the like.

The widespread use of computers has brought the keyboard to a large number of people who have never been adequately trained in proper hand posture. Most untrained people tend to let their wrists droop, i.e., go into extension and often have the wrist rest directly on a work surface immediately in front of the keyboard. This posture of wrist extension puts excessive pressure on the median nerve in the carpal tunnel and can lean to debilitating carpal tunnel syndrome disease. This disease is a major cause of lost time and wages in the work place in the United States.

It is known that one can reduce the incidence of carpal tunnel syndrome by forcing the wrist into a neutral, i.e., not hyper-extended or hyper-flexed position. This can be accomplished by wearing a splint. Splints force the hand to maintain a certain prescribed rest position and tend to limit its motion from that rest position.

In another method of attempting to reduce the problem, the wrist can be supported in such a way that it cannot go into extreme hyper-extension. Retrofit extensions of keyboards of computers have been available made out of hard plastic material or in other firm constructions. Such baseboard extensions often start at the level of the base of the keys and continue downward to a supporting table surface. Often, such modifications in keyboards do have the effect of offering some wrist support, but generally, they are not high enough from the operating surface over which the wrist moves to be a truly effective device. If they were made higher, they could further limit wrist hyper-extension but might well interfere with access to certain keys, particularly keys in the lower row where the keyboard is at an angle. Hard supports such as hard plastics or other firm and undistorting supports have the undesirable effect of putting excessive pressure on a very small wrist area. High pressures can lead to undesirable side effects and, in fact, can aggravate the symptoms of carpal tunnel syndrome. Foam rests of a single layer have been used. Such foams are usually made of firm material and, as such, do not cradle the wrist.

SUMMARY OF THE INVENTION

It is an object of this invention to provide means and method for raising and supporting the wrist above an operative surface in front of a keyboard to reduce the tendency for hyper-extension.

Still another object of this invention is to provide a keyboard wrist rest and method of use for supporting wrists in a comfortable position with reduces wrist angulation and stress when manually operating a keyboard and which aids in distributing pressure over a large weight bearing area so that such pressures and stresses are not physiologically excessive.

According to the invention, a keyboard wrist rest for supporting wrists in a comfortable position with reduced wrist angulation and stress when manually operating a keyboard having a defined operative width has a plurality of support layers designed to raise and support the wrist in a raised position with the fingers free to operate the keyboard positioned in front of the wrist rest. The plurality of layers include a firm wrist positioning layer and a wrist cradling layer above the firm layer for lowering pressure on the wrist and adding comfort in use. The support layers have a width providing an operative wrist rest over the keyboard operative wrist width.

Preferably, the plurality of layers are provided by the wrist positioning layer being a firm layer of organic foam with the cradling layer being a softer foam layer. The soft layer provides for the wrist to be impressed into the foam to contour to the wrist and cradle the wrist, thereby, lowering pressures and forces on the wrist and making it more comfortable while the firm foam provides the height necessary to alleviate stresses on the wrist in use of the keyboard. The soft layer is preferably open cell foam.

More preferably, the lower wrist positioning layer has a lower means for anchoring the wrist rest and the softer foam layer overlying the firm foam layer has a stretch cloth overlying it to act as an outersurface to enhance feel of the wrist rest when contacting the wrist of the user.

According the method of this invention, a plural layered wrist rest is positioned in front of a keyboard and in operative relation thereto so that the wrist of a user can rest on a wrist rest while the fingers of a user operate the keyboard. The wrist rest is selected to have a firm lower layer and a soft cradling upper layer to operatively engage and cradle the wrist while supporting it in a proper upright position to avoid undue stresses on the wrist and maintain a physiologically proper positioning the wrist above an operating surface. The firm lower layer provides the desired wrist elevation and the soft cradling layer spreads the wrist surface support area to minimize unit pressure transmitted since a large surface area is supported by the wrist rest.

It is a feature of this invention that the wrist rest can be made relatively inexpensively of conventional materials and can be designed to have proper dimensions for a variety of keyboard devices.

BRIEF DESCRIPTION OF THE DRAWINGS

The above and other features, advantages and details of the present invention will be better understood from a reading of the following specification in conjunction with the accompanying drawings in which.

DESCRIPTION OF PREFERRED EMBODIMENT

Figure 1:
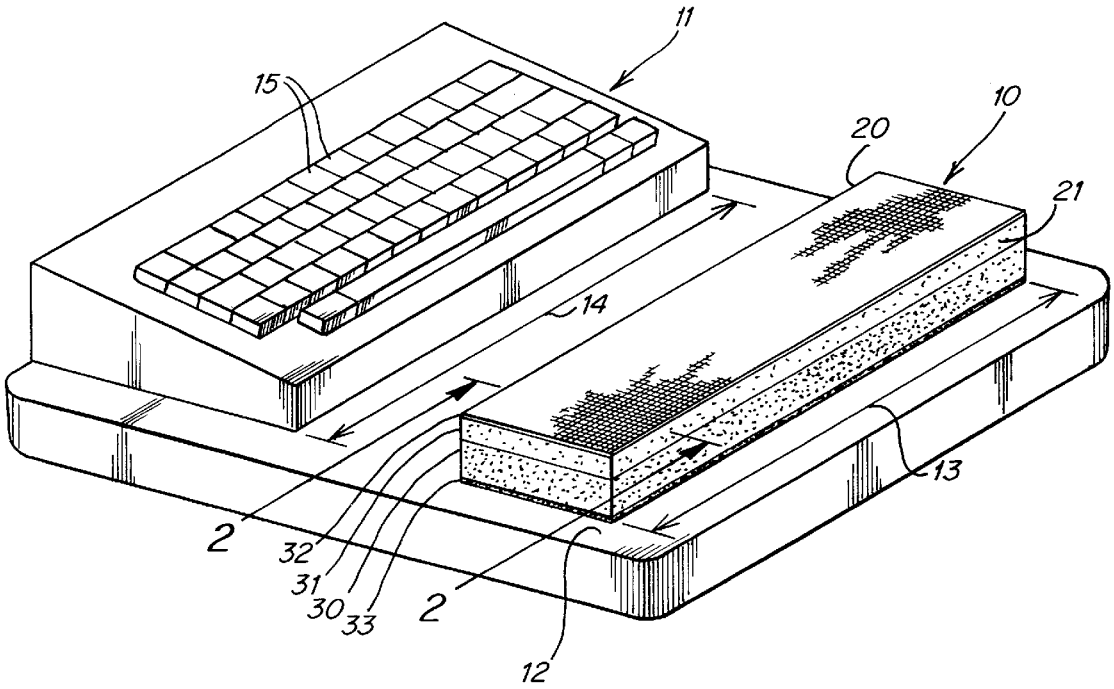
FIG. 1 is a semi-diagramatic view of a wrist rest of a preferred embodiment of this invention positioned in operative relationship in front of a keyboard both resting on an operating surface.
Figure 2:
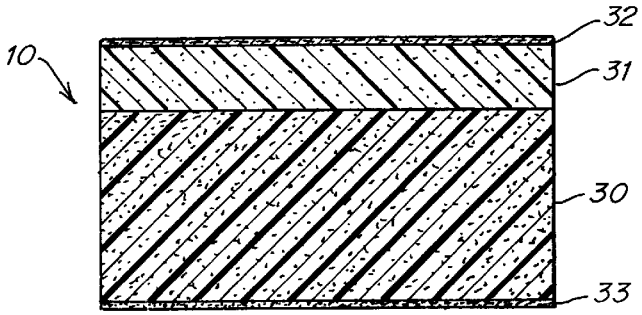
FIG. 2 is a cross-sectional view of the preferred embodiment of the wrist rest taken through line 2—2 of FIG. 1.

With reference now to the drawings and, more particularly to FIG. 1, a preferred embodiment of a wrist rest in accordance with this invention is illustrated generally at 10 positioned in operative relationship in front of a keyboard diagramatically shown at 11, both resting on an operating surface 12 with the wrist support having its width 13 coextensive with the width 14 of the keyboard.

The keyboard 11 can be any conventional keyboard, such as a computer keyboard for an IBM, APPLE, TANDY, or any other computer, or a typewriter keyboard or a musical instrument keyboard. The keyboard is provided with keys 15 to be operated manually by the fingers of the user as is well known.

The keyboard wrist rest 10 preferably has a width 13 substantially equal to width 14 of the keyboard, but, in all cases provides an operative wrist rest over the operating surface 12. The wrist rest preferably has a width of 18 inches at 13 and a front-to-back dimension from front surface 21 to back surface 20 of approximately 3 inches. The height of the keyboard wrist rest above the surface 12 can vary greatly to accommodate various keyboards.

For example, a 2-inch height is found most useful for a Macintosh computer, a 1½-inch height is preferred for IBM type keyboards, and a 1-inch height is useful for some of the newer, lower profile keyboards.

The wrist rest is layered to provide a support layer designed to raise and support the wrist in a raised position, with the fingers free to operate the keyboard positioned in front of the wrist rest. Preferably, the wrist support is plural layered of different materials to achieve the functions of each layer as desired.

In the preferred embodiment 10, a bottom substantially uniform layer of approximately 1½ inches of a support plastic foam forms the support layer 30. This support layer is designed to provide the proper spacing the of wrist in conjunction with other layers, although it is the main layer to positively position the wrist a defined distance above the operating surface 12. The layer is preferably substantially uniform and preferably has an ILD of 30 or more, so that it is stiff enough to support the wrist. Urethane foams can be used.

Other stiff support foams can be used as will be recognized by those skilled in the art.

Preferably a cradling layer of a softer plastic foam than the firm foam layer 30 is used and adhered directly to the layer 30. Various glues, heat sealing or the like can be used to sandwich the two layers together. The cradling layer 31 is preferably a very soft material that has the ability to contour greatly to and cradle the wrist. This lowers any pressures and forces on the wrist making the wrist rest more comfortable to use over extended periods of time and thus, reduces stresses on the wrist, while angulation is mainly provided for by the firm layer 30. The cradling layer can be from about ½ to 1 inch in thickness. It substantially compresses in use to cradle the wrist, while the support layer 30 provides the height adjustment and support for the wrist above the work surface.

An outer or upper layer 32, or a cloth or fabric top cover is preferably used. The wrist can rest directly on the top cover layer. Fabric interfaces are more comfortable than most cellular plastic interfaces or impermeable or semipermeable sheet plastic (typically vinyl or urethane). The cloth used for layer 32 is preferably of a stretch material such as knit polyester or Lycra, so that conformation to the anatomical details of the wrist is not hindered.

A lower layer 33 can be a pressure sensitive or other adhesive to permanently adhere the wrist support in place on the layer. Alternately, the layer 33 can be a friction resisting layer as, for example, a rubber material to provide a non-slip characteristic, yet allowing the keyboard to be positioned as desired in a plurality of locations. In some cases, a permanent affixation can be made to the keyboard as by having layer 33 extend towards the keyboard as a stiff hard plastic sheet adhered to layer 30. This sheet extends under the keyboard and the weight of the keyboard can be used to provide proper positioning. Alternately, the sheet (not shown) can be adhered to the keyboard or to the surface 12 by adhesives or velcro type fastenings.

As will be understood, the keyboard can be any keyboard and the wrist lying on the surface 32 is protected and supported while the fingers can manually operated the keys of a variety of different instruments. The exact positioning of the wrist support in front of the keyboard can vary greatly, although, having the wrist support lie directly adjacent the front surface of the keyboard or spaced very near thereto is preferred. This distance can be varied to accommodate the finger and hand length of various users. In all cases, by having a small variety of different size wrist supports, substantially uniform protection can be available to a wide variety of users.

The soft foam of upper layer 31 is preferably a polyurethane foam which has characteristics as follows: soft enough so that it deforms and cradles the wrist under only the weight of the wrist. Preferably, the foam is open cell so perspiration collected in use from the wrist can be passed off by evaporation through the outer fabric. Preferably indentions force deflection values of the foam are from about 89 to 223 and bale rebound resilience value Test H, ASTMD3574-4-81 are from about 2.5 to about 4.5.

One preferred foam for upper layer 31 is Confor Foam (T-36) foam originally produced by Specialty Composites, Inc. of Newark, Del. and now produced by EAR Specialty Composite Corp. of Indianapolis, Ind. Confor Foams useful to provide a cradling function are listed in Table A below:

TYPICAL PROPERTIES

| Product Designation:* | | T-38 | T-36 |
|---|---|---|---|
| Stiffness: | | Soft | Very Soft |
| Color: | | Pink | Yellow |
| Density:** Test A | | 5.7-6.0 lb/cu.ft. | |
| Tensile Strength: kPa | | 62 | 34 |
| **(Test E) psi | | 9 | 5 |
| Ultimate Elongation: pct. **Test E | | 150 | 150 |
| Compression Set:CT at 50% pct. **Test D | | 1 | 1 |
| Ball Rebound Resilience Value: pct. **Test H | | 2.5 | 2.5 |
| Indentation Force Deflection: 25% IFD Value - IFD-Newtons | | 134 | 89 |
| ILD-pounds **Test B1 | | 30 | 20 |
| Load Bearing vs Compression Stress: psi to compress sample- | 10% ***SCC809 | .45 | .33 |
| | 25% | .53 | . 37 |
| | 50% | .69 | .42 |
| | 65% | .97 | .59 |
| Flame Retardant | | CAL117 and FAR25-853B | |

All tests conducted at 22° C. and 44% R.H.
*FR designates fire retardant T-Foam; NF designates T-Foam without fire retardant additives
**ASTM D3574-81
***Compressive load applied in increments. Sample thickness measured 20 seconds after each load increase.

Confor Foams are viscoelastic, i.e., they exhibit deformation characteristics directly related to the rate of loading. For example, with very rapid impulse load, there is very little immediate deflection of the material. However, as the load is sustained deflection progresses. Under a very light load, such as a wrist resting on a block of the foam, there is very little immediate deflection and the wrist slowly sinks into the material. Sinking progresses until the load is at equilibrium. Thus, in effect, the wrist is cradled in the foam. If the wrist is quickly removed, then the impression of the wrist stays in the foam and only slowly does the foam recover to its original shape.

Both the hard or firm foam layer and softer layer can be of conventional organic resin foams such as rubber foam, urethane foam polyvinyl chloride foam and the like.

While the specific embodiment of the invention has been shown and described, many variations are possible. While a generally rectangular wrist support is preferred for efficiency of use, the geometric shape of the support can vary greatly. In all cases, the width 13 is preferably operatively related to the width of the keyboard to provide a wrist support over the entire width of the keyboard. Circular, irregular and like shapes can be used if desired.

While dimensions 3 inches×18 inches×2 inches have been described, other height, length and width dimensions can be used as desired for particular applications. Generally, the top to bottom overall dimension is in the range of from 1 to 3 inches, the side to side dimension is in the range of from 4 to 2 inches and the front to back dimension is in the range of from 1 to 4 inches.

The particular foams can vary greatly. In some cases, the lower layer 30 need not be a foam as such but, can provide the support with sufficient cushioning provided by cradling layer 31 to provide an overall comfort feel to the user in use. In such cases, the layer 30 can be any structural material which in conjunction with the cradling layer, supports the wrist at the height required. Preferably, the overall wrist rest is lightweight, i.e. under two pounds and preferably under one pound in weight, and is resilient and conformable to slightly irregular surfaces.

According to the method of this invention, a wrist rest for a keyboard is designed to have plural layers. The plural layered wrist rest is positioned in front of the keyboard in an operative relation thereto to enable the wrist of a user to rest on the wrist support while being cradled by the wrist support and automatically contoured to the wrist of the user. The wrist support is then utilized to manually support the wrist while the fingers manually manipulate the keyboard.

In all cases, it is preferred that the wrists are elevated, cradled, and given just the right amount of support to keep them from hyper-extending. In all cases, provision is made to positively position the wrist support as by a non-slip bottom or adherence to a working surface. The keyboard wrist rest does not impede the hand or finger function and can be used as a preventative device or a helping device in cases of mild carpal tunnel syndrome. In all cases, the wrist support protects the wrist from tasks requiring frequent repetitive motion, muscular exhortion, and excessive wrist angulation of more than 10 degrees flextion or extension. The wrist support can increase a skilled operator's typing speed and can properly position the hands of the user even in the case of users who are not aware of proper wrist position.

What is claimed is:

1. A keyboard wrist rest for supporting wrists in a comfortable position with reduced wrist angulation and stress when manually operating a keyboard having a defined operative width, said wrist rest comprising, a plurality of support layers designed to raise and support the wrist in a raised position with the fingers free to operate said keyboard positioned in front of said wrist rest, said plurality of layers including a firm wrist positioning layer formed of a firm layer of organic foam having an ILD of at least 30, a resiliently yieldable wrist cradling layer formed of a viscoelastic open cell foam above said firm layer for lowering forces on the wrist and adding comfort in use, said support having a width for providing an operative wrist rest over said keyboard defined operative width.

2. A keyboard wrist rest in accordance with claim 1, wherein means are provided for positioning said wrist rest in proper alignment with said keyboard, said wrist rest defining a substantially planar bottom designed to support said wrist rest on a flat surface on which said keyboard is mounted.

3. A wrist rest in accordance with claim 2, wherein said means comprises a high friction layer underlying said firm layer.

4. A wrist rest in accordance with claim 2, wherein said means comprises pressure-sensitive adhesive forming a layer.

5. A wrist rest in accordance with claim 2, wherein a layer overlies said wrist positioning layer formed of a stretch cloth material and said keyboard wrist rest consists essentially of said cloth material, said first wrist positioning layer and said wrist cradling layer.

6. A keyboard wrist rest in accordance with claim 5, wherein said viscoelastic softer foam has an indentation force deflection value of from about 89 to about 223.

7. A keyboard wrist rest in accordance with claim 2, having a height of from 1 to 3 inches, a width of from 4 to 12 inches, and a front-to-back depth of from 1 to 4 inches.

8. A wrist rest having a length, depth, and thickness, comprising a) a support layer;

b) a low friction surface layer bonded to the support layer; and c) a base layer bonded to the support layer and having a first compression deflection pressure, wherein the support layer is made of foam rubber having a second compression deflection pressure, the first deflection compression pressure being higher than the second compression deflection pressure, wherein the thickness of the wrist rest is about from ½ to 1 inch.

9. The wrist rest of claim 8, wherein the support layer is made of foam rubber.

10. A wrist rest having a length, depth and thickness, comprising:

a) a support layer;

b) a surface layer overlying the support layer; and c) a base layer bonded to the support layer and having a first compression deflection pressure, wherein the support layer is made of foam having a second compression deflection pressure, the first deflection compression pressure being higher than the second compression deflection pressure, wherein the wrist rest has a thickness up to 1 inch.

11. A wrist rest in accordance with claim 10 wherein said surface layer is a low friction surface layer bonded to the support layer and said support layer is made of a foam rubber.

12. A wrist rest having a length, depth, and thickness, comprising a) a support layer;

b) a low friction surface layer bonded to the support layer; and c) a base layer bonded to the support layer and having a first compression deflection pressure, wherein the support layer is made of foam rubber having a second compression deflection pressure, the first deflection compression pressure being higher than the second compression deflection pressure, wherein the thickness of the wrist rest is about from 1 to 3 inches.

13. A wrist rest having a length, depth, and thickness, comprising a) a support layer;

b) a surface layer overlying the support layer; and c) a base layer bonded to the support layer and having a first compression deflection pressure, wherein the support layer is made of foam having a second compression deflection pressure, the first deflection compression pressure being higher than the second compression deflection pressure, wherein the wrist rest has a thickness up to 3 inches.

* * * * *